US005862814A

United States Patent [19]

Janik et al.

[11] Patent Number: 5,862,814

[45] Date of Patent: Jan. 26, 1999

[54] BARRETTE HAVING INTERCHANGEABLE ATTACHMENT MEMBERS

[76] Inventors: Brenda Janik, 6006 Stoddard Ct., #101, Alexandria, Va. 22315; Kimberly Janik, 315 Hoyt St., Dunkirk, N.Y. 14048

[21] Appl. No.: 685,830

[22] Filed: Jul. 25, 1996

[51] Int. Cl.[6] ..... A45D 8/28

[52] U.S. Cl. ..... 132/275; 132/278

[58] Field of Search ..... 132/273, 275, 132/276, 278, 279

[56] References Cited

U.S. PATENT DOCUMENTS

| | | | |
|---|---|---|---|
| 1,072,903 | 9/1913 | Bippart . | |
| 1,234,308 | 7/1917 | Droll | 132/275 |
| 2,152,313 | 3/1939 | Kayne et al. . | |
| 2,169,596 | 8/1939 | Solomon . | |
| 2,170,778 | 8/1939 | Huppert | 132/278 |
| 2,361,772 | 10/1944 | Kaplan . | |
| 2,461,934 | 2/1949 | Solomon . | |
| 2,767,721 | 10/1956 | Cockley . | |
| 3,704,717 | 12/1972 | Morand et al. . | |
| 3,817,260 | 6/1974 | Kleine . | |
| 3,881,501 | 5/1975 | Kleine . | |
| 4,753,252 | 6/1988 | Boxer . | |
| 4,912,944 | 4/1990 | Crosley et al. | 132/275 |
| 4,991,607 | 2/1991 | Chen . | |
| 5,062,436 | 11/1991 | Emsellem . | |
| 5,284,167 | 2/1994 | Gill . | |
| 5,379,783 | 1/1995 | Healzer et al. | 132/275 |
| 5,398,705 | 3/1995 | Hiltbrand et al. . | |
| 5,524,651 | 6/1996 | Young et al. | 132/275 |
| 5,634,479 | 6/1997 | Jordan et al. | 132/275 |

FOREIGN PATENT DOCUMENTS

| | | | |
|---|---|---|---|
| 2455444 | 1/1981 | France | 132/279 |
| 2684855 | 6/1993 | France | 132/276 |

*Primary Examiner*—Todd E. Manahan
*Attorney, Agent, or Firm*—Nixon & Vanderhye PC

[57] ABSTRACT

A barrette includes a frame having a reinforced central portion, a latch member pivotally secured to the frame, and an attachment receiving assembly rigidly secured to the side of the frame opposite from the latch member that structurally reinforces the frame. The attachment receiving assembly includes at least one attachment bracket that is adapted to support a decorative attachment. A plurality of attachment members supporting various decorative attachments can be interchangeably secured to the attachment receiving assembly thus enabling the barrette wearer to create a barrette that matches the barrette wearer's outfit or color scheme. A plurality of attachment members that are interchangeably engageable with the barrette may be provided in a barrette kit.

30 Claims, 3 Drawing Sheets

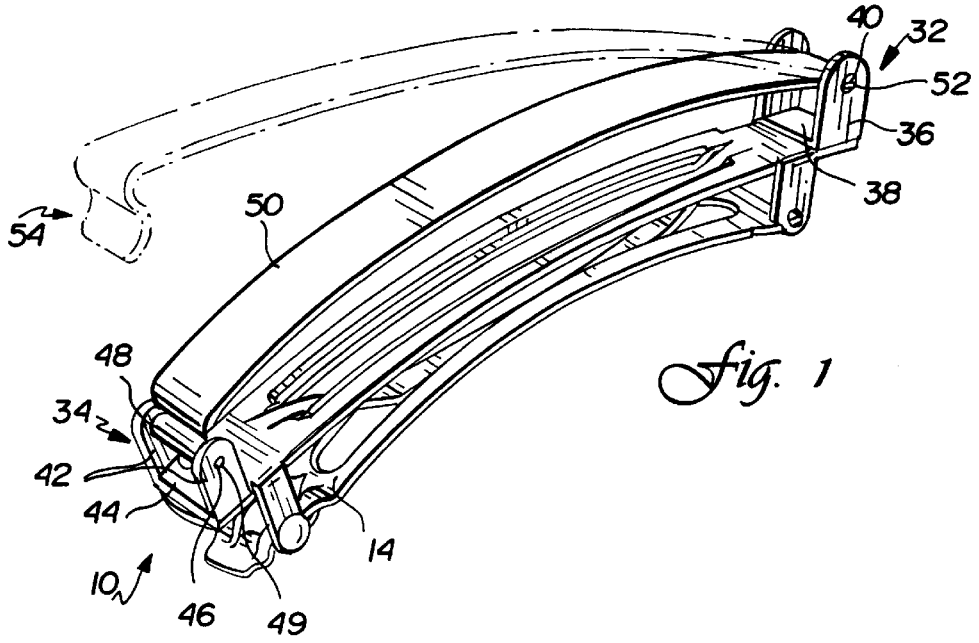
fig. 1
fig. 2
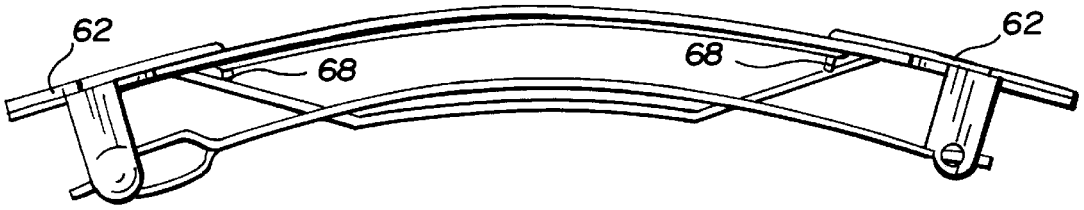
fig. 3
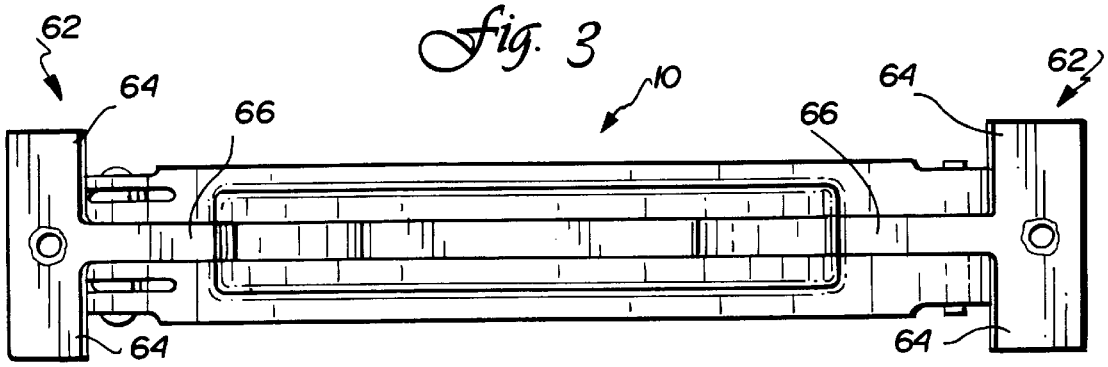

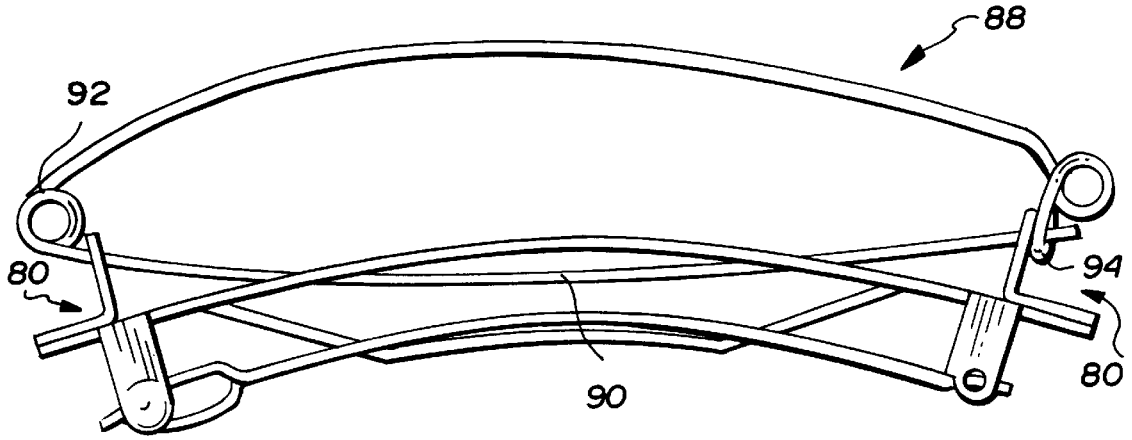
Fig. 6
Fig. 7 Prior Art
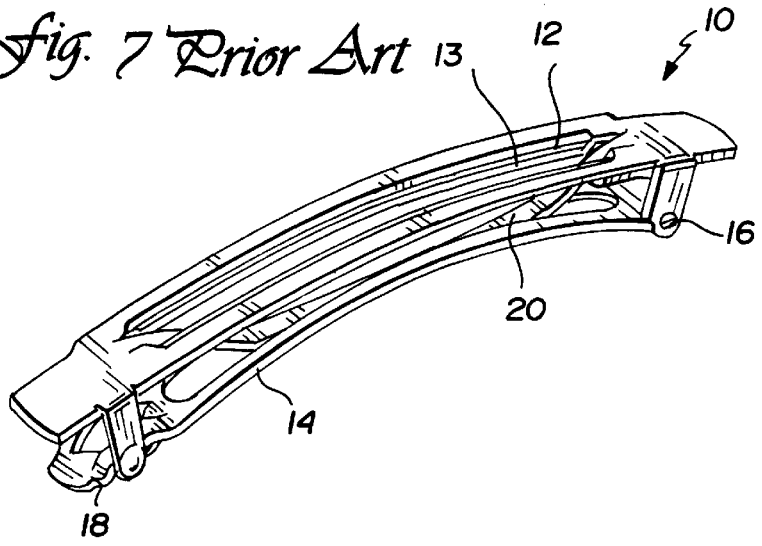

BARRETTE HAVING INTERCHANGEABLE ATTACHMENT MEMBERS

BACKGROUND OF THE INVENTION

The present invention relates to barrettes and, in particular, to a structurally reinforced barrette including an attachment receiving assembly for interchangeably receiving a decorative attachment.

It has been known to provide a barrette having a sturdy frame and cross member as illustrated in FIG. 7. This barrette includes a frame 10 having a reinforced central portion 12 and a central aperture 13. The central portion is reinforced by an indented surface. A latch member 14 is pivotally secured at one end 16 to the frame and releasably secured at its other end 18 to the frame. A resilient member 20 is cut out of the central portion and serves to secure the latch member about the wearer's hair. Typically, a decorative member is fixed to the frame on a side of the frame opposite from the latch member 14.

In order for a barrette wearer to have a variety of colors and fabrics to select from, it is necessary for the barrette wearer to purchase multiple barrettes, one for each color scheme and/or fabric desired. Of course, this can become expensive, particularly if the barrette wearer prefers barrettes of a high quality.

It would therefore be advantageous to provide a single high quality barrette having multiple interchangeable decorative attachments. In this regard, the barrette wearer need only purchase a single barrette along with multiple attachments of different color schemes and fabrics or the like. The wearer can then interchange the decorative attachments to match a particular outfit or color scheme, etc. Attempts have been made to provide such barrettes having interchangeable decorative attachments. However, these barrettes typically have not been of adequate quality and/or do not provide sufficient latching mechanisms.

SUMMARY OF THE INVENTION

It is therefore an object of the invention to provide a barrette including an attachment receiving assembly that serves to structurally reinforce the barrette frame and to interchangeably receive a plurality of decorative attachments. It is a further object of the invention to provide a barrette kit including a barrette and a plurality of decorative barrette attachments. Finally, it is an object of the invention to provide a method of constructing a quality barrette.

These and other objects of the invention are achieved by providing a barrette including a frame having a reinforced central portion, a latch member pivotally secured to the frame and an attachment receiving assembly rigidly secured to a side of the frame opposite from the latch member. The attachment receiving assembly structurally reinforces the frame. The reinforced central portion may include a depressed region formed in the side of the frame opposite from the latch member. The attachment receiving assembly preferably includes at least one attachment bracket secured to the frame, wherein the attachment bracket covers an area sufficient to structurally reinforce the frame. In a preferred arrangement, the attachment bracket is welded to the side. The attachment receiving assembly may further including an attachment member adapted to support a decorative attachment. In this regard, the attachment bracket is configured to releasably receive the attachment member.

In one embodiment of the invention, two attachment brackets are fixed to the side of the frame. The attachment member includes a pivot end pivotally secured to one of the attachment brackets and a release end releasably secured to the other of the brackets. The attachment member is pivotable between an open position and a closed position. In this regard, the one of the attachment brackets preferably includes a substantially U-shaped pivot bracket, and the other of the attachment brackets preferably includes a substantially U-shaped connector bracket. The attachment member is pivotally secured to the U-shaped pivot bracket at the pivot end and releasably securable to the U-shaped connector bracket at the release end. The U-shaped pivot bracket preferably includes two pivot extensions extending substantially perpendicular to the frame, wherein each of the pivot extensions includes a pivot aperture. The attachment member includes opposed pivot pegs at a pivot end that are received in the pivot bracket pivot apertures. The U-shaped connector bracket preferably includes two shaft extensions extending substantially perpendicular to the frame that each include a shaft aperture, and a connector shaft having connector shaft pegs disposed between the shaft extensions. The pegs are received in the connector bracket shaft apertures. In this regard, the attachment member includes an engagement tab at a connection end that is releasably engageable with the connector shaft. Finally, the connector shaft is preferably rotatable in the U-shaped connector bracket to facilitate engagement and disengagement of the attachment member.

In another embodiment of the invention, two attachment brackets are fixed to the side of the frame, and include attachment member engaging portions extending beyond a width of the side to define opposing rails. In this regard, the attachment member includes a pair of slots engageable with the opposing rails, respectively. The attachment member may further include a plurality of tabs extending along a length of the attachment member on opposite sides of the attachment member. The tabs are bent so as to define the opposing rails. The attachment brackets are preferably substantially T-shaped and are secured to opposing ends of the frame such that the legs of the T-shape point toward each other, wherein the cross member of the T-shape comprises the opposing rails. In this regard, the frame may include a central aperture disposed in the reinforced central portion, wherein the legs of the T-shape have a connector at ends thereof that is disposed in the central aperture.

In yet another embodiment of the invention, two attachment brackets are fixed to the frame that each include a support leg rigidly secured to the frame and an extension leg extending substantially perpendicular to the frame. In this regard, each of the extension legs is provided with an engagement aperture, wherein the engagement apertures are configured to receive the attachment member. The attachment member may include an attachment shaft that is insertable through the engagement apertures.

In accordance with another aspect of the invention, there is provided a barrette kit including the barrette according to the invention noted above, and a plurality of attachment members interchangeably engageable with the barrette. In this regard, each of the attachment members is adapted to support a decorative attachment.

In accordance with yet another aspect of the invention, there is provided a method of manufacturing a barrette, including a frame having a reinforced central portion and a latch member pivotally secured to the frame. The method includes the step of (a) securing an attachment receiving assembly to a side of the frame opposite from the latch member thereby structurally reinforcing the frame. Step (a) may be practiced by (b) attaching at least one attachment bracket to the side of the frame and (c) providing the at least one attachment bracket with an area attached to the frame sufficient to structurally reinforce the frame. Step (b) is preferably practiced by welding. Finally, the method may further include attaching one of a plurality of interchangeable attachment members, each supporting a decorative attachment, to the attachment bracket.

BRIEF DESCRIPTION OF THE DRAWINGS

These and other aspects and advantages of the present invention will become apparent from the following detailed description of preferred embodiments when read in conjunction with the accompanying drawings, in which:

FIG. 1 is a perspective view of a first embodiment according to the present invention;

FIG. 2 is a plan view of a second embodiment according to the invention;

FIG. 3 is a side view of the barrette illustrated in FIG. 2;

FIG. 6 is a side view of the barrette illustrated in FIG. 5 including its attachment member; and FIG. 7 is a perspective view of a conventional barrette.

DETAILED DESCRIPTION OF PREFERRED EMBODIMENTS

Figure 4:
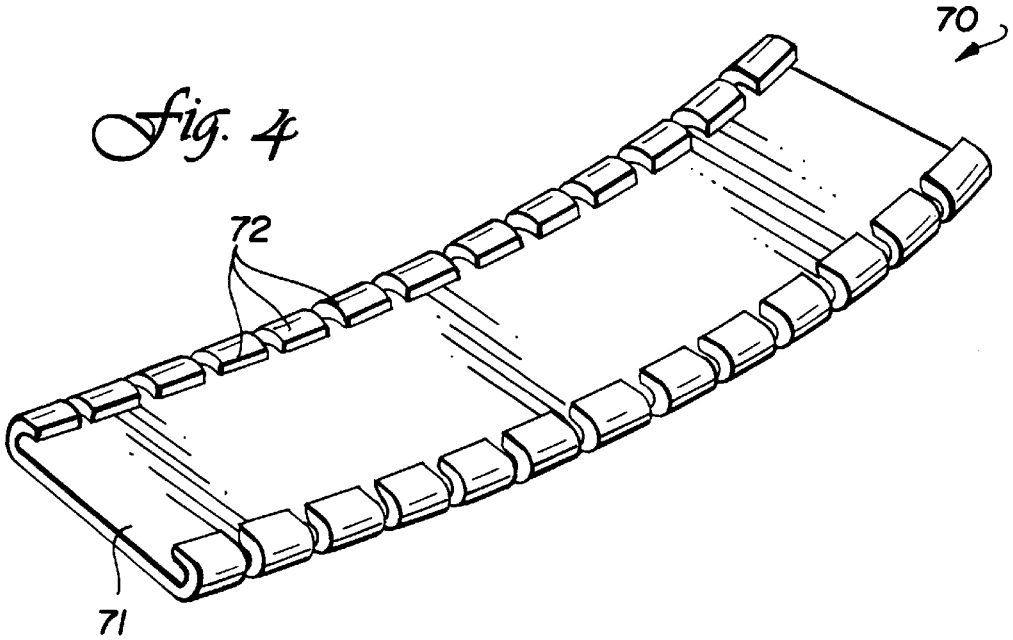
FIG. 4 is a perspective view of an attachment member for the barrette illustrated in FIG. 2.

The present invention relates to an improvement in the conventional barrette including a frame 10 having a reinforced central portion 12 and pivotally supporting a latch member 14 as described above with respect to FIG. 7. FIG. 1 illustrates a first embodiment of the barrette according to the present invention. In this embodiment, a pair of substantially U-shaped attachment brackets 32, 34 are secured to the frame 10 on the outside surface of the frame (i.e., the side of the frame that is opposite from the latch member 14). The brackets 32, 34 are preferably welded to the frame 10. A first bracket, for example, bracket 32, is a pivot bracket formed of two spaced pivot extensions 36 extending substantially perpendicular to the frame 10 and a bracket base 38 in a U-shape. A pivot aperture 40 is provided axially aligned in each pivot extension 36.

The other bracket, for example bracket 34, is a connector bracket and includes a pair of spaced shaft extensions 42 extending substantially perpendicular to the frame 10. The extensions 42 are connected by a bracket base 44 in a U-shape. A shaft aperture 46 is provided axially aligned in each shaft extension 42. A connector shaft 48 is rotatably mounted between the shaft extensions 42 by a pair of pegs 49 secured to the connector shaft 48 and received in the connector bracket shaft apertures 46.

An attachment member 50 is pivotally secured to the frame 10 by the pivot bracket 32 and the connector bracket 34. The attachment bracket 50 at a pivot end includes a pair of pivot pegs 52 that are received in the pivot apertures 40 of the pivot bracket 32. In this regard, the attachment member 50 is adapted to pivot about the pivot pegs 52 in the pivot apertures 40. A release end of the attachment member 50 includes an engagement tab 54 that is releasably engageable with the shaft 48 of the connector bracket 34. The engagement tab 54 is preferably formed with an S-shape such that the attachment member 50 can be secured to the connector shaft in an inside position as shown in FIG. 1 or in an outside position (not shown). Of course, the engagement tab is flexible enough to be mounted in either position. Because the connector shaft 48 is rotatably mounted in the connector bracket 34, engagement and disengagement of the attachment member 50 are facilitated.

The attachment member is thus pivotable between an open position as shown in dashed line in FIG. 1 and a closed position as shown in solid line in FIG. 1. In the open position, the attachment member can receive a tubular or the like decorative attachment. Multiple decorative attachments can be provided in a barrette kit to customize the look of the barrette. After the decorative attachment is secured to the attachment member 50, the attachment member 50 is pivoted to its closed position.

The attachment brackets 32, 34 are preferably formed of a rigid material such as stainless steel. The brackets 32, 34 are rigidly secured to a sufficient area of the frame so as to structurally reinforce the frame. That is, the rigid material affixed over an area of the frame, for example, serves to prevent a twisting moment applied to the barrette from affecting the general shape of the frame. If the area covered is too small, the frame may be subjected to slight deformation, affecting the ultimate look and functionality of the barrette. In a barrette that is about 3½" long, an area of at least $1/32$ in$^2$ and preferably about $1/16$ in$^2$ or more is sufficient to resist any deformation by, for example, a twisting moment or the like, depending of course on the size of the twisting moment. In this first embodiment, with the attachment member 50 in the closed position, the frame 10 is further structurally reinforced.

FIGS. 2–4 illustrate a second embodiment of the barrette according to the present invention. In this embodiment, two substantially T-shaped attachment brackets 62 are secured at opposing ends of the frame 10 on the side of the frame that is opposite from the latch member 14. In this regard, the attachment brackets are preferably welded to the frame 10.

Each attachment bracket 62 includes attachment member engaging portions 64 extending beyond a width of the frame 10. The attachment member engaging portions 64 form the cross member of the T-shape as shown in FIG. 3. As described in greater detail below, the attachment member engaging portions 64 define opposing rails on opposite sides of the frame 10 for supporting the attachment member according to this embodiment. Each attachment bracket 62 includes a leg 66 disposed substantially perpendicularly to the attachment member engaging portions 64. The leg 66 forms the leg of the T-shape. Each leg 66 includes a connector 68 at its innermost end that is disposed in the central aperture 13 of the frame 10 that serves to prevent the attachment brackets 62 from pivoting about their connection point and serves to align the attachment brackets 62 during assembly (FIG. 2). Similar to the first embodiment, the brackets 62 structurally reinforce the frame 10.

FIG. 4 illustrates the attachment member according to this embodiment of the invention. The attachment member 70 is formed of a shape corresponding to the barrette frame 10. A plurality of tabs 72 extend along a length of the attachment member 70 on opposite sides of the attachment member as shown in FIG. 4. As further shown in FIG. 4, the tabs are bent over the main body 71 of the attachment member 70 so as to define opposing rails. The rails are spaced apart by a width substantially corresponding to the width of the attachment member engaging portions 64 of the attachment brackets 62. The rails of the attachment member 70 defined by the tabs 72 are slid over the attachment member engaging portions 64 in the longitudinal direction. In this manner, the attachment member 70 can be readily attached and detached from the barrette. In a preferred arrangement, a decorative fabric or the like is secured to the attachment member 70, and multiple attachment members 70 having varying decorations are included with the barrette as a kit. In addition, the attachment member 70 itself may be constructed of a decorative material (such as gold).

Figure 5:
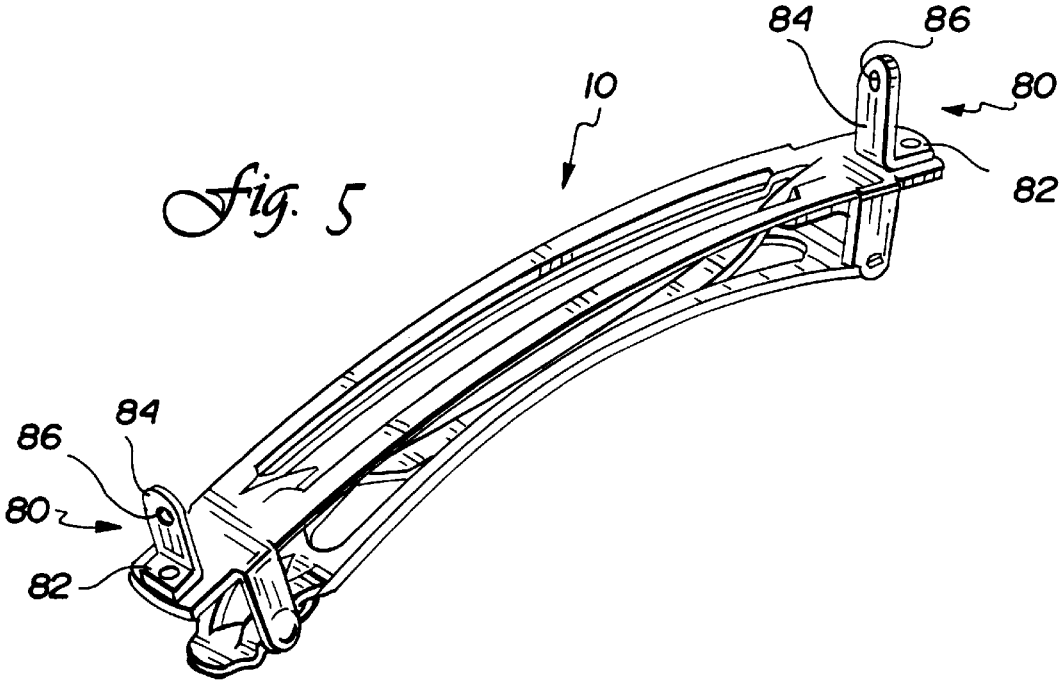
FIG. 5 is a perspective view of a third embodiment according to the present invention.

Still another alternative embodiment according to the present invention is illustrated in FIGS. 5 and 6. In this embodiment, two attachment brackets 80 are fixed to the frame 10 on a side of the frame opposite from the latch member 14. Each of the attachment brackets includes a support leg 82 rigidly secured to the frame 10 and an extension leg 84 extending substantially perpendicular to the frame 10. Each of the extension legs 84 is provided with an engagement aperture 86. The attachment brackets 80 are preferably welded to the frame 10, and the support leg 82 is disposed over a sufficient area of the frame to structurally reinforce the frame.

Referring to FIG. 6, the attachment member 88 with respect to this embodiment of the invention is preferably formed of a single wire (such as piano wire) in a "safety pin" like configuration. That is, a connecting leg 90 of the attachment member 88 is biased outwardly by the wire being wound into a coil spring arrangement 92 at one end. The opposite end of the attachment member 88 is provided with a hook 94 that receives the attachment leg 90 and secures the attachment leg 90 in a closed position. The attachment member 88 is secured to the barrette by threading the attachment leg 90 through the engagement apertures 86 of the attachment brackets 80. Of course, alternative attachment members may be suitable that include a connecting leg engageable with the engagement apertures 86, and the invention is not meant to be limited to the illustrated attachment member.

A decorative fabric or the like can be secured to the attachment member 88 in any suitable manner. The barrette may be sold as a kit with a plurality of attachment members 18 including varying decorative attachments.

In accordance with the present invention, a structurally reinforced barrette is provided with an attachment receiving assembly for interchangeably receiving any of a plurality of decorative attachments. A barrette wearer thus need only purchase a single barrette with multiple attachment members which support different decorative attachments.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A barrette kit comprising:

a barrette including:

a frame having a reinforced central portion, a latch member pivotally secured to said frame such that said latch member pivots relative to said frame, an attachment member secured to a side of said frame opposite from said latch member, and a pair of attachment brackets rigidly secured to said side of said frame and separate from each other, said attachment brackets structurally reinforcing said frame by the rigid connection between said attachment brackets and said side of said frame, said attachment brackets releasably supporting said attachment member to said frame; and a plurality of decorative attachments interchangeably engageable with said attachment member.

2. A barrette comprising:

a frame having a reinforced central portion;

a latch member pivotally secured to said frame such that said latch member pivots relative to said frame;

an attachment member secured to a side of said frame opposite from said latch member; and a pair of attachment brackets rigidly secured to said side of said frame and separate from each other, said attachment brackets structurally reinforcing said frame by the rigid connection between said attachment brackets and said side of said frame, and said attachment brackets releasably supporting said attachment member to said frame.

3. A barrette according to claim 2, wherein said reinforced central portion comprises a depressed region formed in said side of said frame opposite from said latch member.

4. A barrette according to claim 2, wherein said attachment brackets are welded to said side.

5. A barrette according to claim 2, wherein said attachment member is adapted to support a decorative attachment.

6. A barrette according to claim 2, wherein said attachment member comprises pivot end pivotally secured to one of said attachment brackets and a release end releasably securable to the other of said brackets, said attachment member being pivotable between an open position and a closed position.

7. A barrette according to claim 6, wherein said one of said attachment brackets comprises a substantially U-shaped pivot bracket and wherein said other of said attachment brackets comprises a substantially U-shaped connector bracket, said attachment member being pivotally secured to said U-shaped pivot bracket at said pivot end and releasably securable to said U-shaped connector bracket at said release end.

8. A barrette according to claim 7, wherein said U-shaped pivot bracket comprises two pivot extensions extending substantially perpendicular to said side of said frame, each of said pivot extensions having a pivot aperture, said attachment member comprising opposed pivot pegs at a pivot end that are received in the pivot bracket pivot apertures.

9. A barrette according to claim 7, wherein said U-shaped connector bracket comprises:

two shaft extensions extending substantially perpendicular to said side of said frame, each of said shaft extensions having a shaft aperture; and a connector shaft having connector shaft pegs disposed between said shaft extensions, said pegs being received in the connector bracket shaft apertures, wherein said attachment member comprises an engagement tab at a connection end that is releasably engageable with said connector shaft.

10. A barrette according to claim 9, wherein said connector shaft is rotatable in said U-shaped connector bracket facilitating engagement and disengagement of said attachment member.

11. A barrette according to claim 2, wherein said attachment brackets comprises attachment member engaging portions extending beyond a width of said side defining opposing rails, said attachment member comprising a pair of slots engageable with said opposing rails, respectively.

12. A barrette according to claim 11, wherein said attachment member further comprises a plurality of tabs extending along a length of said attachment member on opposite sides of said attachment member, said tabs being bent so as to define said opposing rails.

13. A barrette according to claim 11, wherein said attachment brackets are substantially T-shaped and are secured to opposing ends of said frame such that the legs of the T-shape point toward each other, the cross member of the T-shape comprising said opposing rails.

14. A barrette according to claim 13, wherein said frame comprises a central aperture disposed in said reinforced central portion, the legs of the T-shape having a connector at ends thereof, said connectors being disposed in said central aperture.

15. A barrette according to claim 2, wherein each of said attachment brackets comprises a support leg rigidly secured to said side of said frame and an extension leg extending substantially perpendicular to said side of said frame, each of said extension legs having an engagement aperture, wherein said engagement apertures are configured to receive said attachment member.

16. A barrette according to claim 15, wherein said attachment member comprises an attachment shaft, said attachment shaft being insertable through said engagement apertures.

17. A barrette according to claim 2, wherein one of said attachment brackets comprises a substantially U-shaped pivot bracket, and the other of said attachment brackets comprises a substantially U-shaped connector bracket.

18. A barrette according to claim 17, wherein said attachment member is pivotally secured at a pivot end to said pivot bracket and releasably securable at a release end to said connector bracket, said U-shaped pivot bracket comprising two pivot extensions extending substantially perpendicular to said side of said frame, each of said pivot extensions having a pivot aperture, wherein said attachment member comprises opposed pivot pegs at said pivot end that are received in the pivot bracket pivot apertures.

19. A barrette according to claim 18, wherein said U-shaped connector bracket comprises:

two shaft extensions extending substantially perpendicular to said side of said frame, each of said shaft extensions having a shaft aperture; and a connector shaft having connector shaft pegs disposed between said shaft extensions, said pegs being received in the connector bracket shaft apertures, wherein said attachment member comprises an engagement tab at a connection end that is releasably engageable with said connector shaft.

20. A barrette according to claim 19, wherein said connector shaft is rotatable in said U-shaped connector bracket facilitating engagement and disengagement of said attachment member.

21. A barrette according to claim 2, wherein said attachment brackets comprises attachment member engaging portions extending beyond a width of said side defining opposing rails.

22. A barrette according to claim 21, wherein said attachment brackets are substantially T-shaped and are secured to opposing ends of said frame such that the legs of the T-shape point toward each other, the cross member of the T-shape comprising said opposing rails.

23. A barrette according to claim 22, wherein said frame comprises a central aperture disposed in said reinforced central portion, the legs of the T-shape having a connector at ends thereof, said connectors being disposed in said central aperture.

24. A barrette according to claim 2, wherein each of said attachment brackets comprises a support leg rigidly secured to said side of said frame and an extension leg extending substantially perpendicular to said side of said frame, each of said extension legs having an engagement aperture.

25. A method of manufacturing a barrette including a frame having a reinforced central portion and a latch member, the method comprising:

(a) pivotally securing the latch member to the frame such that the latch member pivots relative to the frame;

(b) rigidly securing a pair of attachment brackets separate from each other to a side of the frame opposite from the latch member thereby structurally reinforcing the frame; and (c) releasably attaching an attachment member to said attachment brackets.

26. A method according to claim 25, wherein step (b) is practiced by welding.

27. A method according to claim 25, further comprising attaching one of a plurality of interchangeable decorative attachments to said attachment member.

28. A barrette comprising:

a frame having a reinforced central portion;

a latch member pivotally secured to said frame;

an attachment receiving assembly rigidly secured to a side of said frame opposite from said latch member, said attachment receiving assembly structurally reinforcing said frame, wherein said attachment receiving assembly comprises two attachment brackets fixed to said side of said frame, one of said attachment brackets comprising a substantially U-shaped pivot bracket, and the other of said attachment brackets comprising a substantially U-shaped connector bracket; and an attachment member pivotally secured at a pivot end to said pivot bracket and releasably securable at a release end to said connector bracket, said U-shaped pivot bracket comprising two pivot extensions extending substantially perpendicular to said side of said frame, each of said pivot extensions having a pivot aperture, wherein said attachment member comprises opposed pivot pegs at said pivot end that are received in the pivot bracket pivot apertures.

29. A barrette according to claim 28, wherein said U-shaped connector bracket comprises:

two shaft extensions extending substantially perpendicular to said side of said frame, each of said shaft extensions having a shaft aperture; and a connector shaft having connector shaft pegs disposed between said shaft extensions, said pegs being received in the connector bracket shaft apertures, wherein said attachment member comprises an engagement tab at a connection end that is releasably engageable with said connector shaft.

30. A barrette according to claim 29, wherein said connector shaft is rotatable in said U-shaped connector bracket facilitating engagement and disengagement of said attachment member.

* * * * *